US006422251B1

(12) United States Patent
Tseng

(10) Patent No.: US 6,422,251 B1
(45) **Date of Patent: *Jul. 23, 2002**

(54) UMBRELLA HAVING A SIMPLIFIED CONFIGURATION

(75) Inventor: Cheng Yuan Tseng, Taichung (TW)

(73) Assignee: Windbrella Products Corp., NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/735,870

(22) Filed: Dec. 14, 2000

(51) Int. Cl.[7] ..... A45B 25/08

(52) U.S. Cl. ..... 135/28; 135/39; 135/20.3; 135/40

(58) Field of Search ..... 135/28, 37, 38, 135/39, 40, 41, 25.4, 25.33, 22, 23, 20.3

(56) References Cited

U.S. PATENT DOCUMENTS 3,156,249 A * 11/1964 Biderman ..... 135/39 X
3,658,076 A 4/1972 Yasuda ..... 135/22
5,144,969 A * 9/1992 Chou et al. ..... 135/39
5,184,639 A * 2/1993 Lee ..... 135/28
5,398,709 A * 3/1995 Lee ..... 135/28
5,690,132 A * 11/1997 Lin et al. ..... 135/24
6,024,108 A * 2/2000 Kuo et al. ..... 135/24
6,076,540 A * 6/2000 You ..... 135/22
6,095,169 A * 8/2000 Lin et al. ..... 135/31
6,216,712 B1 * 4/2001 Lin et al. ..... 135/28 X
6,247,483 B1 * 6/2001 Tung ..... 135/38

* cited by examiner

*Primary Examiner*—Carl D. Friedman
*Assistant Examiner*—Winnie Yip
(74) *Attorney, Agent, or Firm*—Charles E. Baxley

(57) ABSTRACT

An umbrella includes a tube having a lower handle and having an upper whale bone device. A barrel is slidably engaged on the tube and coupled to the whale bone device. A spring-biased catch is received in the tube and selectively engaged into the barrel to lock the barrel to the tube. A latch is slidably received in the barrel for selectively disengaging the catch from the barrel to release the barrel from the tube. The latch is received in the barrel which is moved away from the handle when the whale bone device is opened, such that the latch will not be actuated inadvertently.

6 Claims, 4 Drawing Sheets

UMBRELLA HAVING A SIMPLIFIED CONFIGURATION

BACKGROUND OF THE INVENTION

1. Field of the Invention

The present invention relates to an umbrella, and more particularly to an umbrella having a simplified configuration.

2. Description of the Prior Art

U.S. Pat. No. 3,658,076 to Yasuda discloses a typical umbrella including two or more spring members that are required to be engaged in the middle or central tube for controlling the operation of the umbrella, and including a latch or a lock member required to be disposed in the bottom or lower portion of the tube for latching to a slide or a sliding ring and for locking the umbrella at a folded configuration. The umbrella includes a complicated configuration that may not be easily manufactured and assembled. In addition, when the umbrella is opened at a working position, the latch or the lock member that is disposed in the bottom or lower portion of the tube will be exposed or extended outward of the tube and will be depressed by the users inadvertently. Relatively, the users, such as the hands of the users that hold the handle of the umbrella, may also be hurt by the latch or the lock member that is exposed or extended outward of the tube.

The present invention has arisen to mitigate and/or obviate the afore-described disadvantages of the conventional umbrellas.

SUMMARY OF THE INVENTION

The primary objective of the present invention is to provide an umbrella including a simplified configuration for facilitating the manufacturing and the assembling of the umbrella.

The other objective of the present invention is to provide an umbrella including a latch that will be slided upward of the tube and will not be exposed or extended outward of the lower portion of the tube.

In accordance with one aspect of the invention, there is provided an umbrella comprising a tube including an upper portion and a lower portion having a handle provided thereon, a whale bone device pivotally secured to the upper portion of the tube and movable between an open position and a folded position, a barrel slidably engaged on the tube, the barrel including a channel formed therein, means for coupling the barrel to the whale bone device, a spring-biased catch received in the tube and selectively engageable into the channel of the barrel when the channel of the barrel is aligned with the catch, and a latch slidably received in the barrel for selectively disengaging the catch from the barrel to release the barrel from the tube. The latch is received in the barrel and movable, together with the barrel, away from the handle when the whale bone device is opened to the open position. The umbrella includes a simplified configuration such that the umbrella may be easily manufactured and assembled. The latch of the umbrella will he moved away from the handle when the umbrella is opened such that the latch will not be depressed or actuated inadvertently by the users.

The latch is ring-shaped is slidably received in the channel of the barrel for slidably receiving the tube therein. The latch includes a knob extendible outward of the barrel for being depressed or actuated by the users.

The barrel includes a depression formed therein for receiving the knob. The barrel includes an actuator engaged with the catch for depressing the catch inward of the tube.

The catch includes a recess formed therein for receiving a spring, and includes at least one flange extended therefrom for engaging with the tube and for preventing the catch from being disengaged from the tube.

The coupling means includes a ring slidably engaged on the tube, a stave device pivotally coupled between the ring and the whale bone device, a stave support pivotally coupled between the stave device and the barrel, and a spring engaged between the ring and the barrel for biasing the ring away from the barrel.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
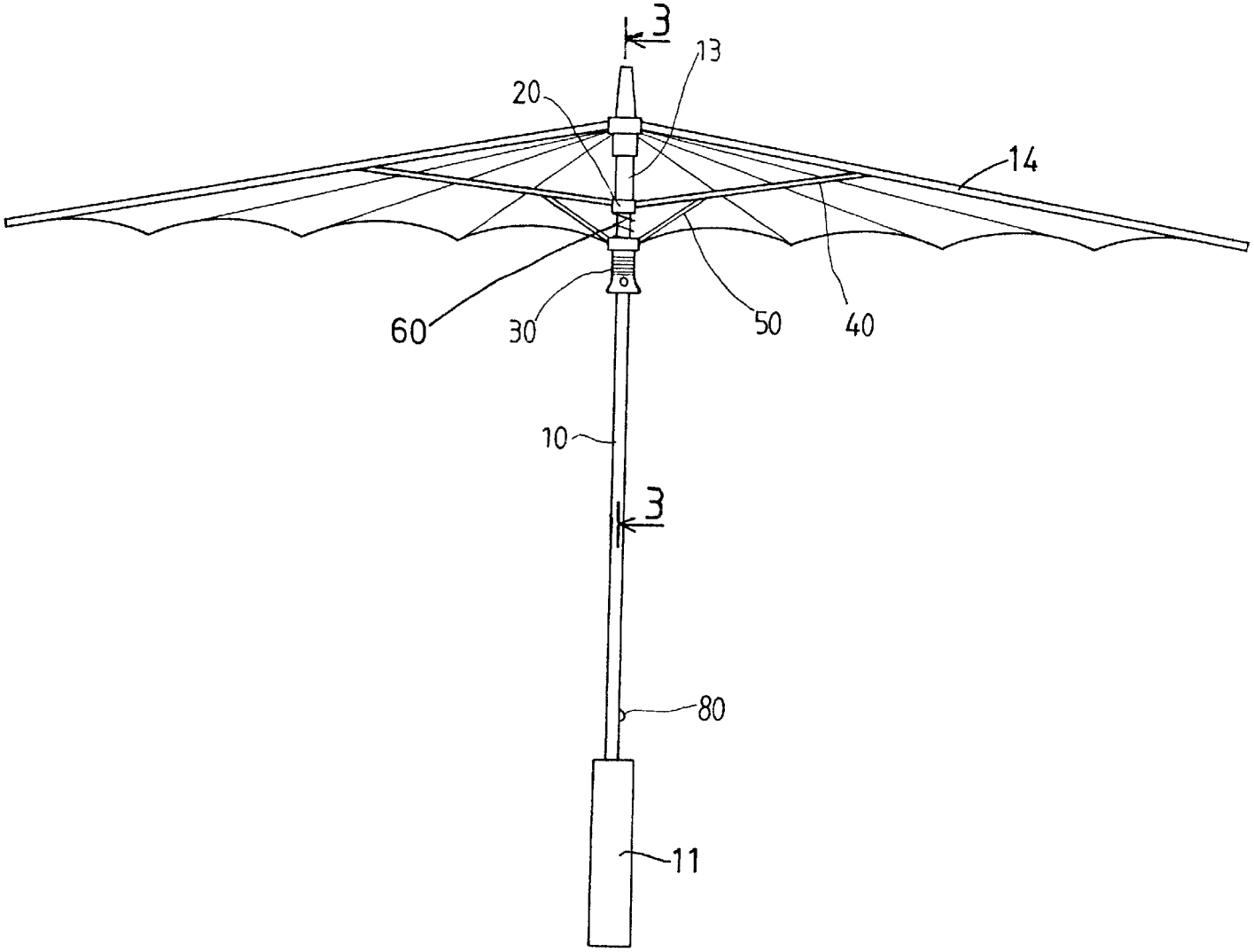
FIG. 1 is a plane schematic view of an umbrella in accordance with the present invention.
Figure 2:
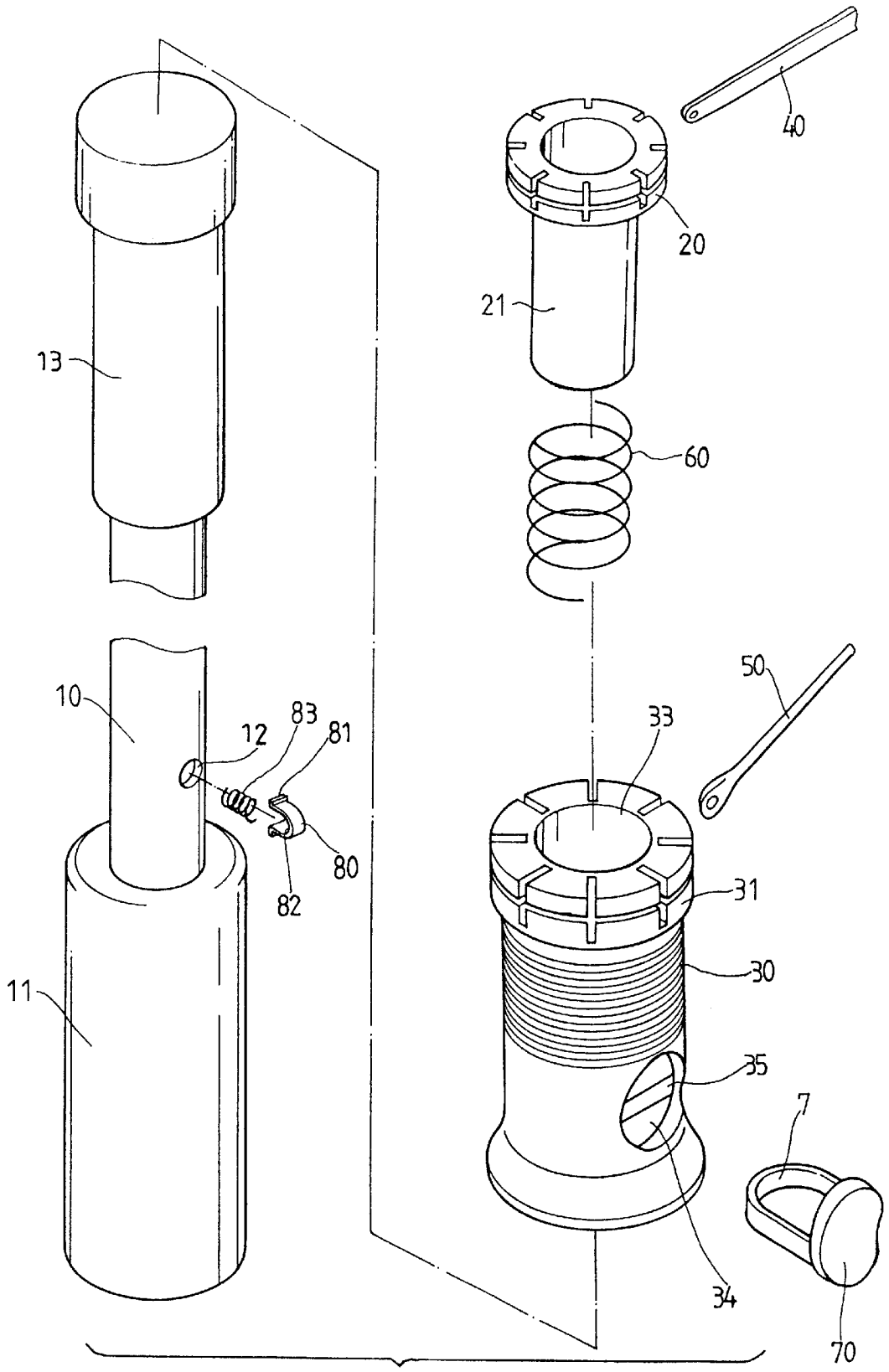
FIG. 2 is a partial exploded view of the umbrella.
Figure 3:
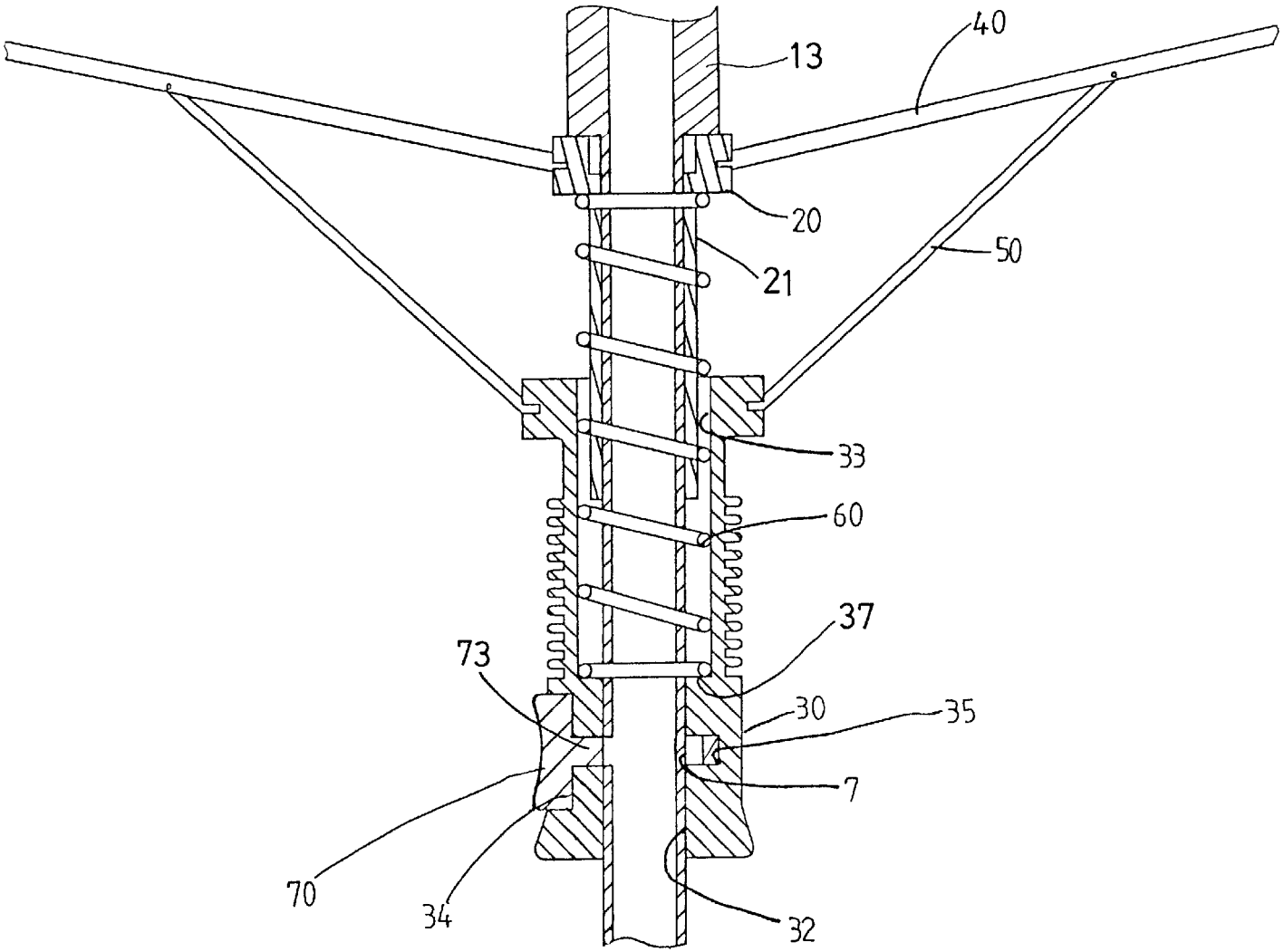
FIG. 3 is a partial cross sectional view taken along 3—3 of FIG. 1.

Referring to the drawings, and initially to FIGS. 1–3, an umbrella in accordance with the present invention comprises a tube 10 including a handle 11 provided and disposed on the bottom portion thereof, and including a stop 13 provided and disposed on the upper portion thereof. A typical whale bone device 14 is pivotally attached to the upper portion of the tube 10 or to the stop 13 and is openable to an open or working position as shown in FIG. 1, and is foldable to a folded or storing position. A ring 20 includes a sleeve 21 provided or disposed or extended downward therefrom and is slidably engaged on the tube 10. A number of typical staves or a typical stave device 40 is pivotally coupled between the whale bone device 14 and the ring 20.

A barrel 30 is also slidably engaged on the tube 10 and disposed below the ring 20 or disposed between the ring 20 and the handle 11. A number of stave supports 50 are pivotally coupled between the barrel 30 and the stave device 40. The barrel 30 preferably includes a ring 31 provided on top thereof for pivotally coupling to the stave supports 50. The barrel 30 includes a bore 32 formed therein for slidably receiving the tube 10 and includes a chamber 33 formed in the upper portion thereof and having an inner diameter greater than that of the bore 32 of the barrel 30 for forming a peripheral shoulder 37 in the barrel 30. A spring 60 is engaged between the ring 20 and the barrel 30, and is engaged on the sleeve 21 and engaged with the peripheral shoulder 37 of the barrel 30. The spring 60 may apply a biasing force against the ring 20 and thus against the stave device 40 in order to open the umbrella to the open or working position. The above described structure is typical and has been disclosed in U.S. Pat. No. 3,658,076 to Yasuda, which is taken as a reference for the present invention.

The lower portion of the tube 10 includes an orifice 12 formed therein for receiving a catch 80 and a spring 83. The catch 80 includes a recess 82 formed therein for receiving the spring 83 and includes one or more flanges 81 extended therefrom for engaging with the tube 10 (FIG. 4) and for preventing the catch 80 from being disengaged from the tube 10. The catch 80 thus may be forced to move inward and outward of the tube 10. The barrel 30 includes a channel 35 laterally formed therein and communicating with or intersecting with the bore 32 of the barrel 30, and includes a depression 34 formed in the outer portion thereof and communicating with the channel 35 of the barrel 30. The catch 80 may be biased inward of the channel 35 of the barrel 30 to lock the barrel 30 to the tube 10 (FIG. 4) when the barrel 30 is moved to the bottom or the lower portion of the tube 10.

Figure 4:
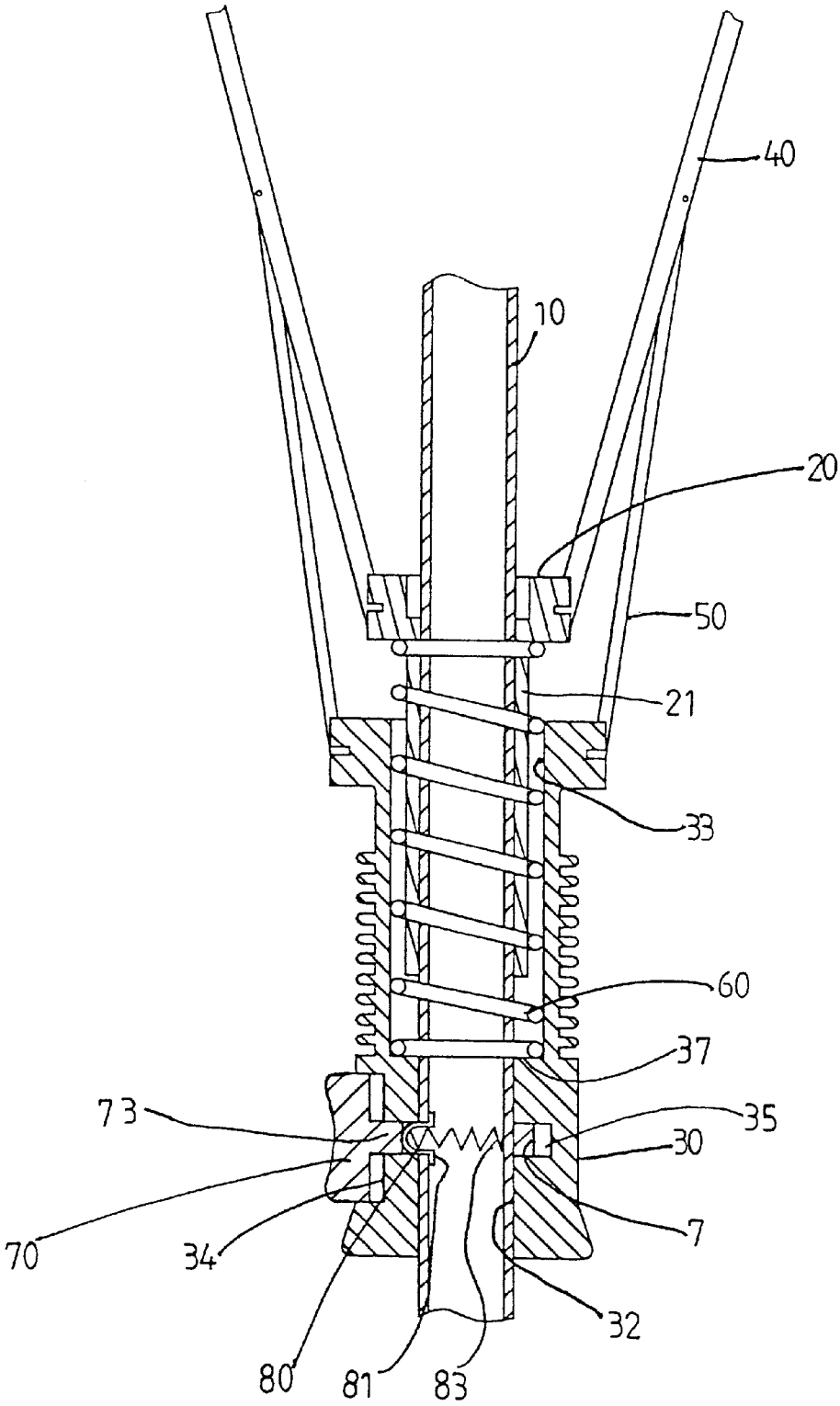
FIG. 4 is a partial cross. sectional view similar to FIG. 3, illustrating the operation of the umbrella.

A latch 7 which is ring-shaped is slidably received in the channel 35 of the barrel 30 and is engaged on the tube 10. Relatively, the tube 10 is slidably received in the ring-shaped latch 7. The latch 7 includes a knob 70 slidably received in the depression 34 of the barrel 30 and extendible outward of the depression 34 of the barrel 30 and includes an actuator 73 extended therefrom, or extended from the knob 70 for engaging with the catch 80 (FIG. 4). The spring 83 may bias the catch 80 to engage into the channel 35 of the barrel 30 and to lock the barrel 30 to the tube 10; and may also bias the knob 70 outward of the depression 34 of the barrel 30. The catch 80 may be forced or moved inward of the tube 10 by the actuator 73 of the latch 7 to release the barrel 30 from the tube 10 when the knob 70 is depressed inward of the depression 34 of the barrel 30 against the spring 83.

In operation, as shown in FIG. 4, when the barrel 30 is pulled to the lower or bottom portion of the tube 10 until the catch 80 is biased to engage into the channel 35 of the barrel 30, the barrel 30 may be latched or locked to the tube 10 by the spring-biased catch 80. When the catch 80 is depressed inward of the tube 10 by the actuator 73 of the latch 7, the barrel 30 will be released from the tube 10. At this moment, the spring 60 may bias the ring 20 upward along the tube 10 to open the umbrella, until the ring 20 is engaged with the stop 13 (FIG. 3).

It is to be noted that the umbrella includes a simplified configuration that may be easily manufactured and assembled. The knob 70 and/or the actuator 73 and/or the latch 7 is received in the barrel 30 and may be moved, together with the barrel 30, upward toward the upper portion of the tube 10, and thus may be moved away from the handle 11 when the umbrella is opened. The latch 7 or the knob 70 of the latch 7 will not be depressed by the users inadvertently. Only the spring-biased catch 80 is slightly biased outward of the tube 10.

Accordingly, the umbrella in accordance with the present invention includes a simplified configuration for facilitating the manufacturing and the assembling of the umbrella, and includes a latch that will be slided upward of the tube and will not be exposed or extended outward of the lower portion of the tube.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An umbrella comprising:

a tube including an upper portion and a lower portion having a handle provided thereon, a whale bone device pivotally secured to said upper portion of said tube and movable between an open position and a folded position, a barrel slidably engaged on said tube, said barrel including a channel formed therein, means for coupling said barrel to said whale bone device, a spring-biased catch received in said tube and selectively engageable into said channel of said barrel when said channel of said barrel is aligned with said catch, and a latch slidably received in said barrel for selectively disengaging said catch from said barrel to release said barrel from said tube, said latch being received in said barrel and movable, together with said barrel, away from said handle when said whale bone device is opened to said open position, and said latch being ring-shaped and being slidably received in said channel of said barrel for slidably receiving said tube therein.

2. The umbrella according to claim 1, wherein said latch includes a knob extendible outward of said barrel.

3. The umbrella according to claim 2, wherein said barrel includes a depression formed therein for receiving said knob.

4. The umbrella according to claim 2, wherein said barrel includes an actuator engaged with said catch for depressing said catch inward of said tube.

5. The umbrella according to claim 1, wherein said catch includes a recess formed therein for receiving a spring, and includes at least one flange extended therefrom for engaging with said tube and for preventing said catch from being disengaged from said tube.

6. The umbrella according to claim 1, wherein said coupling means includes a ring slidably engaged on said tube, a stave device pivotally coupled between said ring and said whale bone device, a stave support pivotally coupled between said stave device and said barrel, and a spring engaged between said ring and said barrel for biasing said ring away from said barrel.

* * * * *